US007887211B2

(12) United States Patent
Summers

(10) Patent No.: US 7,887,211 B2
(45) Date of Patent: Feb. 15, 2011

(54) GLASS BREAKING CAP

(76) Inventor: Todd Summers, 20292 Birch St., Newport Beach, CA (US) 92660

( * ) Notice: Subject to any disclaimer, the term of this patent is extended or adjusted under 35 U.S.C. 154(b) by 0 days.

(21) Appl. No.: 11/982,821

(22) Filed: Nov. 5, 2007

(65) Prior Publication Data

US 2008/0316737 A1 Dec. 25, 2008

Related U.S. Application Data

(63) Continuation of application No. 29/288,817, filed on Jun. 21, 2007.

(60) Provisional application No. 60/965,891, filed on Aug. 23, 2007.

(51) Int. Cl.
*F21L 4/00* (2006.01)

(52) U.S. Cl. ..... 362/102; 362/253; 362/119; 362/202

(58) Field of Classification Search ..... 362/102, 362/109, 253, 457, 119, 202; 463/47.2, 47.4, 463/47.6, 47.7; 16/110.1, 431
See application file for complete search history.

(56) References Cited

U.S. PATENT DOCUMENTS

| | | | | | |
|---|---|---|---|---|---|
| 2,026,077 | A * | 12/1935 | True | 463/47.2 |
| 4,682,987 | A * | 7/1987 | Brady et al. | 51/293 |
| 4,819,137 | A | 4/1989 | Hamilton | 362/102 |
| 5,287,255 | A | 2/1994 | Strodtman | 362/102 |
| 5,363,285 | A | 11/1994 | Wideman | 362/102 |
| 5,407,197 | A | 4/1995 | Parsons | 273/84 R |
| 5,509,653 | A | 4/1996 | Parsons | 273/84 R |
| 5,728,003 | A | 3/1998 | Hustad | 463/47.2 |
| D404,789 | S | 1/1999 | Starrett | D22/117 |
| 6,139,165 | A * | 10/2000 | Crowe | 362/102 |
| 6,199,997 | B1 | 3/2001 | Outsen et al. | 362/109 |
| 6,499,855 | B1 | 12/2002 | Kukuk | 362/102 |
| 6,666,566 | B1 | 12/2003 | Uke | 362/202 |
| 7,004,597 | B2 | 2/2006 | Kukuk | 362/102 |
| 2005/0037847 | A1 | 2/2005 | Pickens, Jr. | 463/47.2 |

* cited by examiner

*Primary Examiner*—Sharon E Payne
(74) *Attorney, Agent, or Firm*—Russo & Duckworth, LLP; David G. Duckworth

(57) ABSTRACT

A glass breaking cap for flashlights, batons and the like is provided. The glass breaking cap has a cylindrical sidewall and a conical top portion. The conical top portion has an apex having an included angle between 86° and 136°. More preferably, the apex has an included angle of 106° to 126° with a preferred included angle of about 116°. Preferably, the glass breaking cap has male or female threads for replacing threaded end caps found on traditional flashlights and batons.

20 Claims, 10 Drawing Sheets

GLASS BREAKING CAP

RELATED APPLICATIONS

This application is a continuation of pending U.S. application Ser. No. 29/288,817, filed Jun. 21, 2007 and a continuation of U.S. provisional application Ser. No. 60/965,891 filed on Aug. 23, 2007.

BACKGROUND OF THE INVENTION

The present invention relates to devices for use by law enforcement, security and emergency personnel. More specifically, the present invention relates to devices for breaking glass.

Law enforcement and emergency personnel are often required to break glass whether for self defense or while responding to an emergency. For example, law enforcement personnel responding to an automobile accident may need to break a vehicle window or windshield to reach a trapped victim. Breaking vehicle glass can be difficult as vehicle windows typically are constructed of tempered glass or are solidified by layers of flexible plastic. Glass windows often present barriers and other emergency situations require breaking glass such as glass doors. Various devices have been used or developed for breaking glass. Emergency personnel such as firemen will often use a hammer or axe to break vehicle glass. Meanwhile, law enforcement personnel will typically use their batons to break windows. Unfortunately, previous glass breaking structures suffer from various drawbacks.

Axes and hammers are unwieldy and may be difficult to carry. Moreover, law enforcement personnel do not typically carry an axe or hammer with them at all times. Batons suffer from their own disadvantages. The traditional baton includes extremities which have a rounded edge. The rounded edge does not concentrate impact sufficiently to easily break glass. Thus, law enforcement personnel must often strike a vehicle window repeatedly or with unwantingly excessive force to break a window. Furthermore, batons are largely ineffective in breaking windows under water, such as in the event an automobile has plunged into a lake or river. Batons also must be swung in an arc, resulting in law enforcement personnel being vulnerable to attack when trying to break a vehicle window. Instead, it would be preferred if a window could be broken by law enforcement personnel using minimal movement.

Tools have been constructed with a very sharp point. For example, U.S. Patent Application No. 2005/0037847 illustrates a martial arts weapon which includes teardrop shaped ends. Though these teardrop shaped ends provide a sharp point, this construction suffers from its own problems. Foremost, many law enforcement personnel do not wish to have a baton having an excessively sharp point so that it can be used as a weapon. Moreover, a baton with a sharp point requires that the law enforcement personnel pay additional diligence and attention when handling the batons to ensure that damage is not done to themselves or objects nearby.

There is thus the need for a glass breaking apparatus which is easy to use and easy to carry.

There is an additional need for a glass breaking tool to be incorporated into hardware that is already carried by emergency and law enforcement personnel in order to diminish the loads that such persons must carry.

There is also a need for a glass breaking tool which is not dangerous to carry.

SUMMARY OF THE INVENTION

With reference to the figures, the present invention is a glass breaking cap which can be attached to a variety of tools including flashlights and batons. The glass breaking cap includes a cylindrical sidewall and a conical top. Of importance, the conical top is formed with an apex having an included angle which is not so sharp as to be particularly dangerous during ordinary handling, but is sufficiently sharp as to concentrate force when a user directs the conical top against glass for breakage. Accordingly, the glass breaking cap of the present invention includes a top having an included angle between 86° and 136°. More preferably, the conical top of the glass breaking cap has an included angle between 106° and 126°. Based upon substantial testing, it has been determined that the preferred included angle for the conical top is about 116°.

The glass breaking cap is constructed for affixing to the end of a flashlight or baton. To this end, the cap may be constructed to affix to a flashlight or baton using a press-fit arrangement. However, most batons and flashlights have a male or female threaded extremity. Accordingly, in preferred embodiments, the glass breaking caps of the present invention include either male threads which project downwardly from the glass breaking cap's cylindrical sidewall, or the glass breaking cap includes female threads formed interior to the glass breaking cap's cylindrical sidewall. Since most flashlights and batons are already formed with a threaded extremity, the glass breaking cap can be affixed to existing flashlight and baton constructions by simply removing the factory installed cap and replacing it with the glass breaking cap of the present invention.

Various modifications of the glass breaking cap may be made without departing from the spirit and scope of the invention. For example, the glass breaking cap may be made from almost any material including metals and ceramics. However, heat treated steels, such as 4140, having a Rockwell hardness of 40 or greater are preferred metals for constructing the glass breaking cap of the present invention. Preferably, the glass breaking cap further includes a black oxide finish. Moreover, the term "conical" is intended to be interpreted relatively loosely so as to include tops which are multi-sided so as to form a substantially conical construction. For example, the glass breaking cap may be constructed substantially as a pyramid to include four or more sides, and such a construction is intended to be within the scope of the invention. However, it is important that such constructions incorporate a tip having an included angle of between 86° and 136°, and more preferably an included angle of between 106° and 126°. Again, the most preferred included angle for the top is approximately 116°.

It is therefore an object of the present invention to provide a glass breaking top which can be incorporated into tools carried by emergency and law enforcement personnel. More particularly, it is an object of the present invention to provide a glass breaking cap which can be incorporated into existing flashlights and batons.

DETAILED DESCRIPTION OF THE INVENTION

Figure 1:
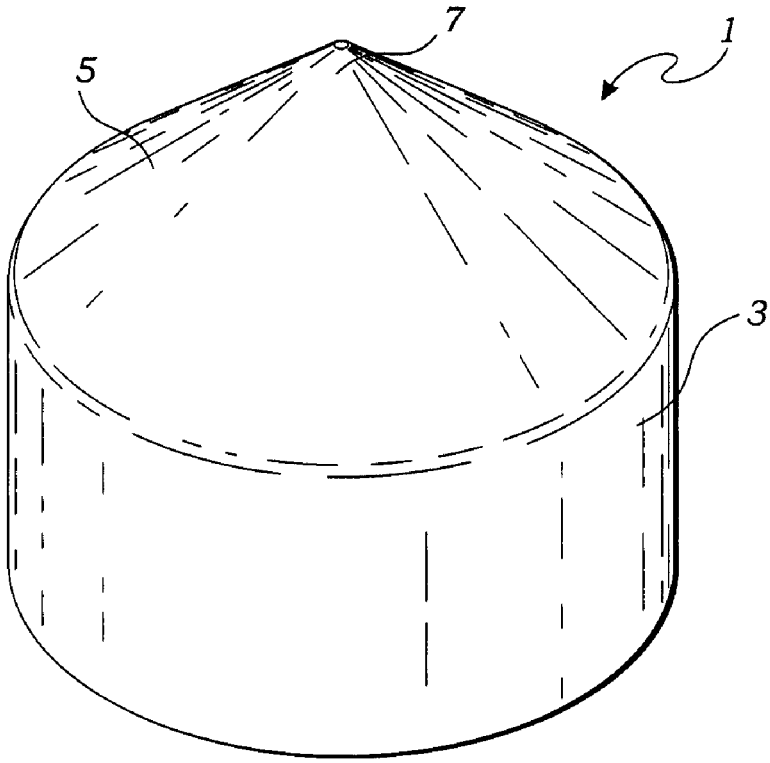
FIG. 1 is a perspective view of the glass breaking cap of the present invention.
Figure 2:
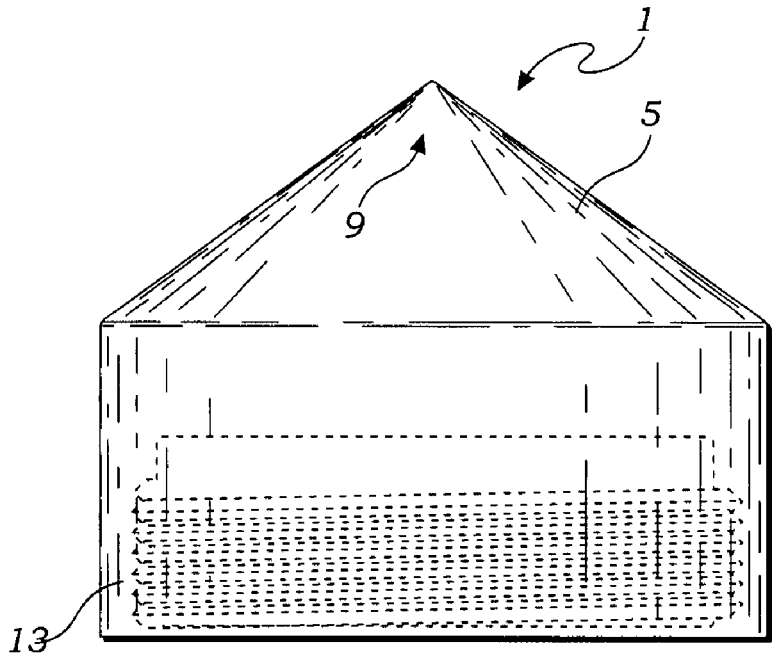
FIG. 2 is a side view of the glass breaking cap of the present invention.
Figure 3:
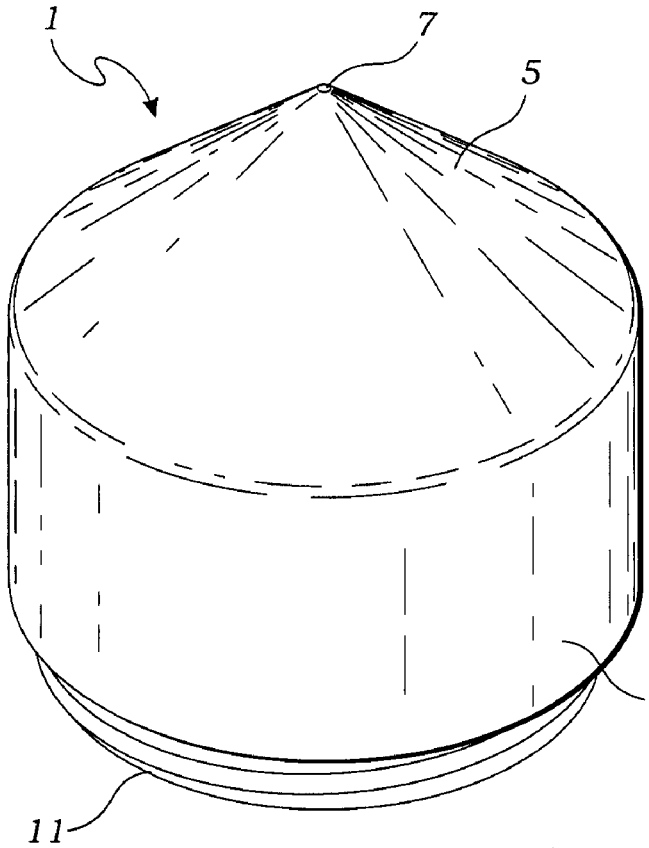
FIG. 3 is a perspective view of the glass breaking cap including male threads.
Figure 4:
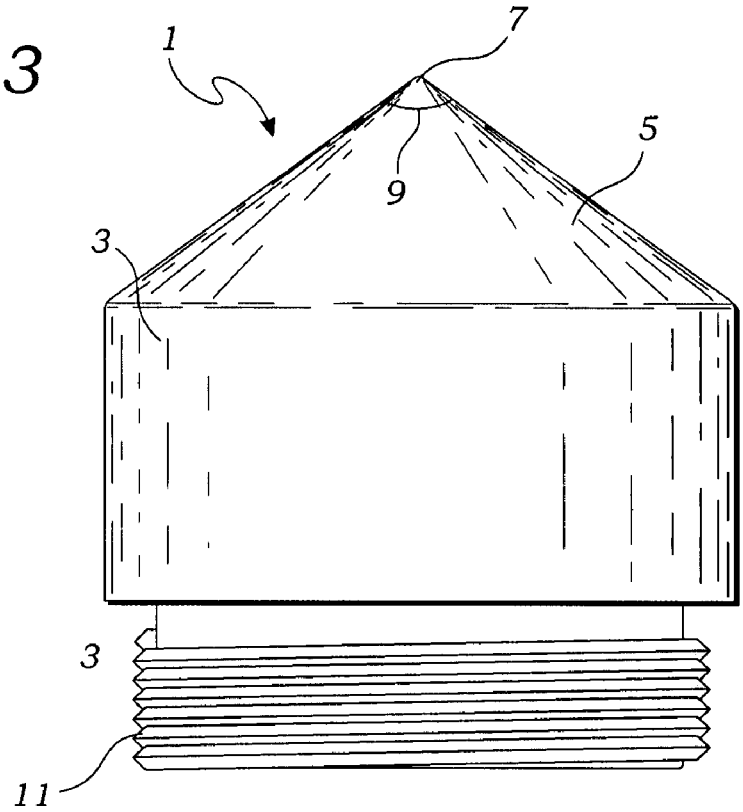
FIG. 4 is a side view of the glass breaking cap including male threads.
Figure 5:
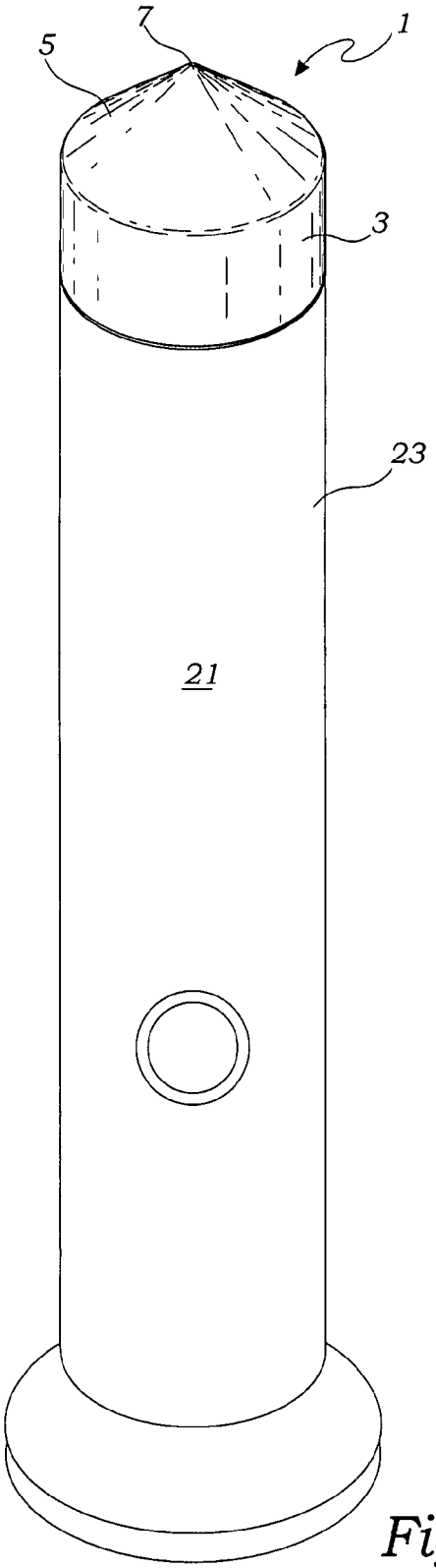
FIG. 5 is a perspective view of the glass breaking cap affixed to a flashlight.
Figure 6:
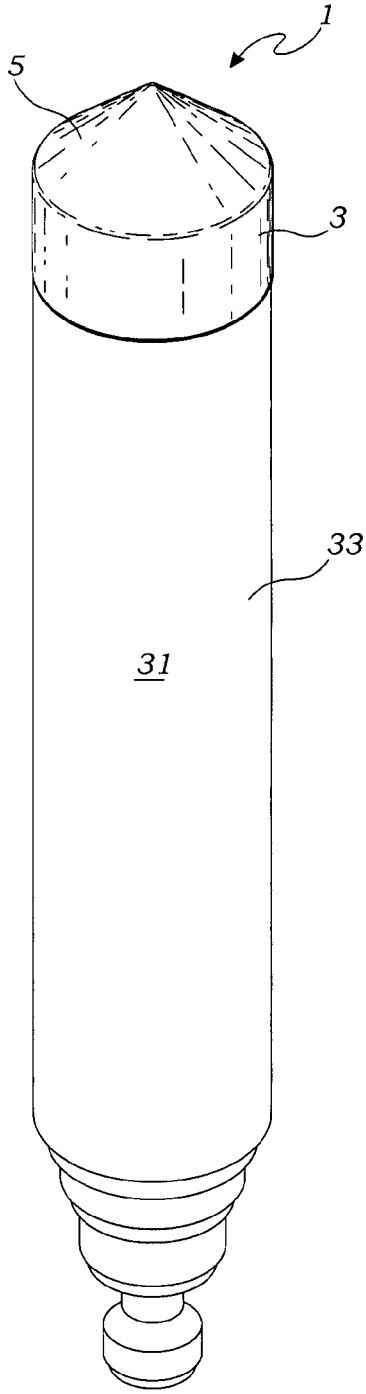
FIG. 6 is a perspective view of the glass breaking cap affixed to a retracted baton.
Figure 7:
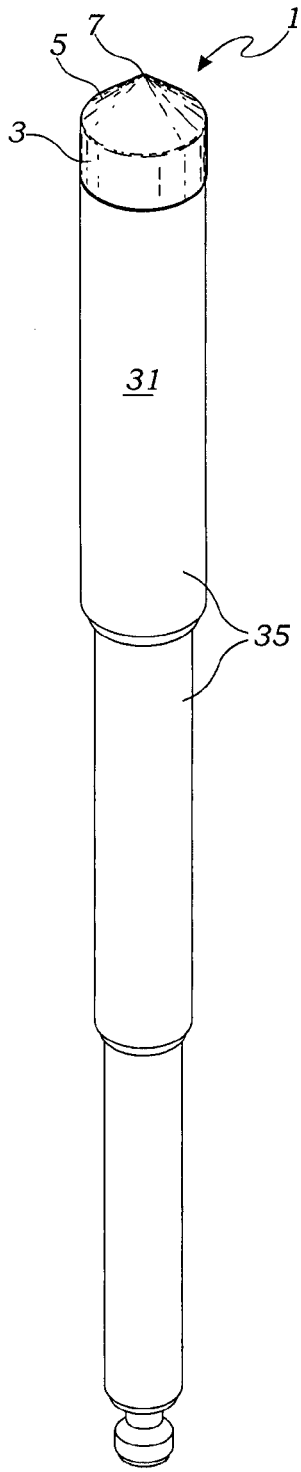
FIG. 7 is a perspective view of the glass breaking cap affixed to an extended baton.
Figure 8:
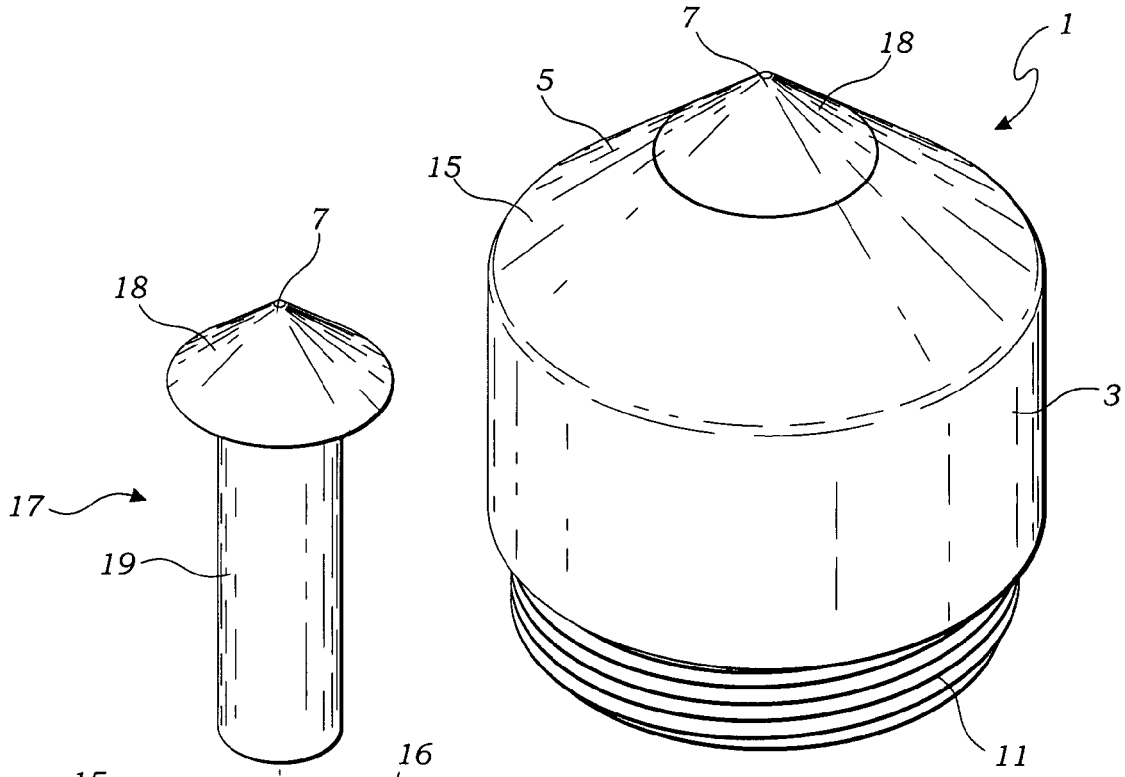
FIG. 8 is a perspective view of a second embodiment of the glass breaking cap constructed in two pieces.
Figure 9:
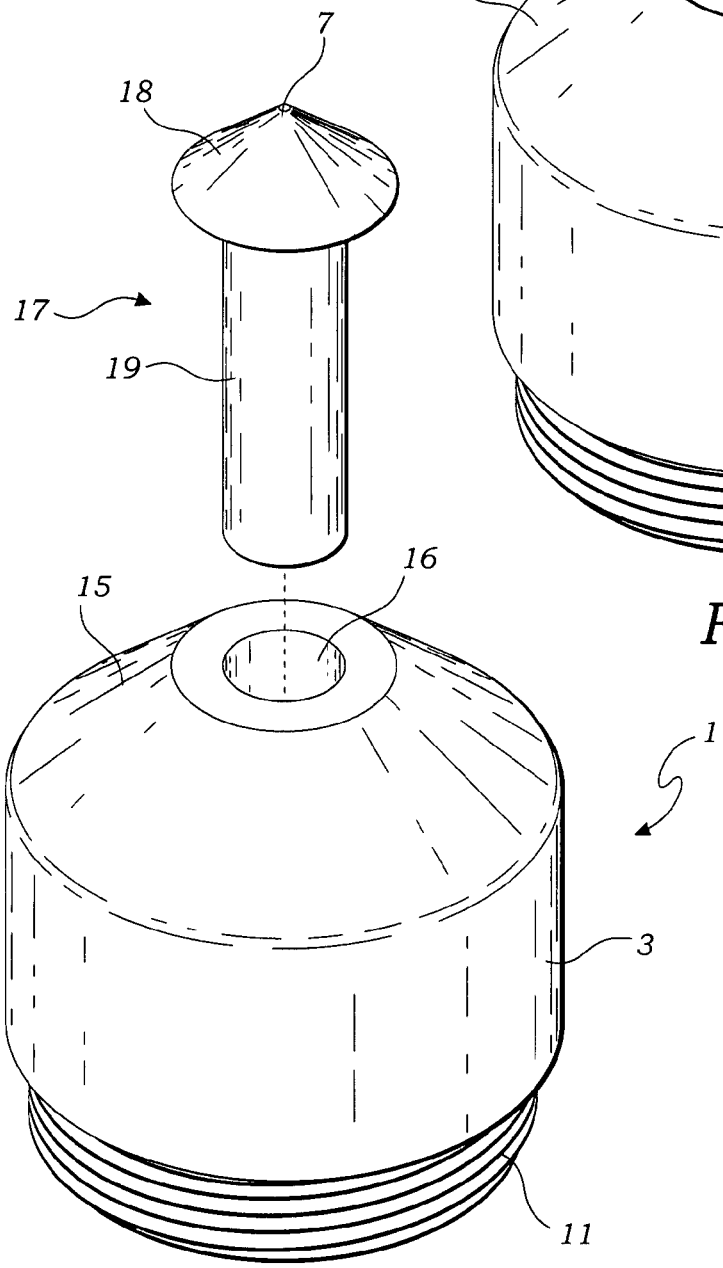
FIG. 9 is an exploded perspective view of the glass breaking cap shown in FIG. 8.

While the present invention is susceptible of embodiment in various forms, as shown in the drawings, hereinafter will be described the presently preferred embodiments of the invention with the understanding that the present disclosure is to be considered as an exemplification of the invention, and is not intended to limit the invention to specific embodiments illustrated.

While the present invention is susceptible of embodiment with reference primarily to FIGS. 1-4, the glass breaking cap 1 of the present invention includes a cylindrical sidewall 3 and a conical top portion 5. The cylindrical sidewall is constructed for affixing to a variety of apparatus, but primarily constructed to affix to batons and flashlights to function as an end cap. To this end, the first embodiment the cylindrical sidewall includes internal female threads 13 (shown in FIG. 2) for engaging the corresponding male threads formed upon the barrel of a flashlight or baton body. In an alternative embodiment illustrated in FIGS. 3 and 4, the cap 1 includes male threads 11 which project downwardly from the cap's cylindrical sidewall 3. Again, the male threads are provided to affix to a flashlight or baton body that is constructed to include corresponding female threads. Though not illustrated in the figures, the glass breaking cap 1 may be affixed to a flashlight 21, baton 31 or similar item using non-threaded connections including adhesives or press-fit constructions. Whether the cap is constructed to include male threads 11 or female threads 13 or other means for attaching to a flashlight or baton, it is intended that the glass breaking cap take the place of end caps typically found on batons and flashlights.

The construction of the conical top portion 5 of the glass breaking cap 1 is of critical importance. The conical top portion is conically shaped to include a top apex 7. Of importance, the apex 7 of the conical top portion has an included angle 9 so that the apex is sufficiently sharp so as to concentrate force when a user directs the conical top against glass for breakage. However, it is also important that the apex and included angle not be so sharp as to be dangerous during ordinary handling.

More particularly, law enforcement personnel often carry a variety of weaponry, but their flashlights and batons are traditionally utilized when non-deadly force is necessary. Moreover, flashlights and batons do not traditionally have any sharp edges which can be used as a weapon or which could cause inadvertent harm to an officer. So, law enforcement personnel trained in using traditional flashlights and batons would prefer to not alter the flashlight or baton constructions so as to be unnecessarily dangerous. Accordingly, the conical top of the present invention has an apex having an included angle which is not so small so as to provide a sharp tip which could be unnecessarily dangerous. After substantial testing, it is preferred that the apex's included angle be at least 86° and even more preferably more than 106° so as to be sufficiently blunt so as to not be unnecessarily hazardous. Moreover, it is preferred that the apex's included angle be less than 136°, and even more preferably less than 126° so as to provide sufficient sharpness in the angle so as to efficiently break glass when the glass breaking cap is manually driven into window glass. Based upon substantial testing, a preferred included angle for the conical top's apex 7 is about 116°.

In a first embodiment, as illustrated in FIGS. 1-7, the glass breaking cap 1 of the present invention is manufactured of one piece. In order to efficiently break glass, preferably the glass breaking cap is made of a metal having a Rockwell hardness greater than 40 so as to not deform when the cap's apex 7 strikes glass. Also preferably, the glass breaking cap is made of a metal having a Rockwell hardness less than 60 so as to facilitate manufacturing and reduce brittleness. A preferred steel for the one piece glass breaking cap construction is heat treated 4140 steel having a Rockwell hardness of 52-55.

An alternative embodiment of the glass breaking cap 1, as illustrated in FIGS. 8-16, the glass breaking cap 1 is constructed in two pieces including an annular element 15 and a tip portion 17. As illustrated in the figures, the cap 1 still includes a cylindrical sidewall 3 and conical top portion 5. However, the two piece construction divides the conical top portion 5 into an annular element 15 and tip portion 17. The annular element has a cross-section which is substantially frusto-conically shaped. In addition, the annular element 15 includes a centrally aligned bore 16. The tip portion 17 includes a conical top 18 and a downwardly projecting shaft 19 which is sized to reside in a press-fit arrangement with the annular element's central bore 16. Since the annular element 15 will not undergo the impact forces of the tip portion 17, in a preferred embodiment, the annular element 15 is made of a metal of lighter weight, in other words less density, and decreased hardness than the tip portion 17. In such a preferred embodiment, the annular element is made of aluminum and the tip portion is made of heat treated 4140 steel having a Rockwell hardness of 52-55.

Figure 10:
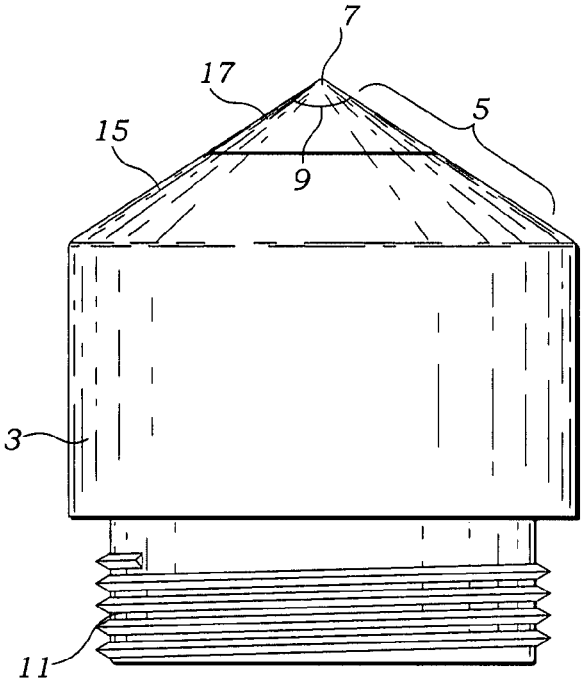
FIG. 10 is a side view of the glass breaking cap shown in FIG. 8.
Figure 11:
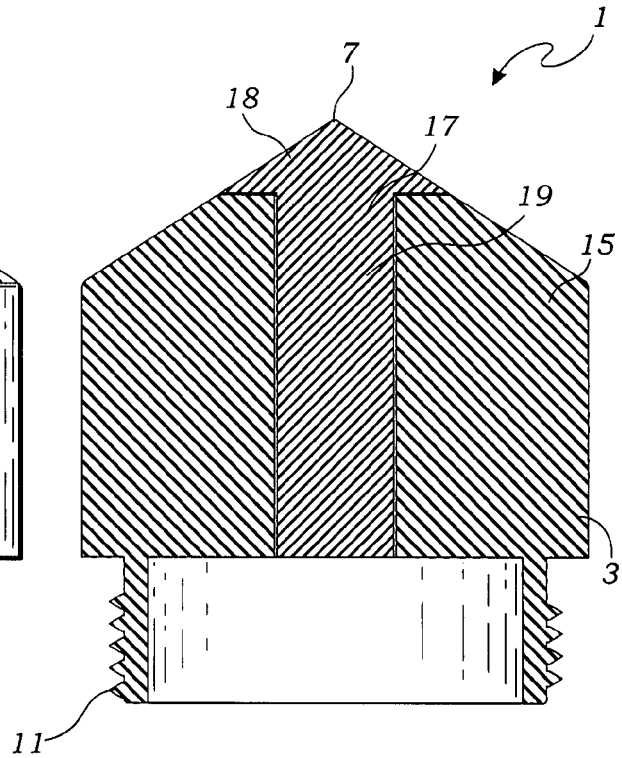
FIG. 11 is a cutaway side view of the glass breaking cap shown in FIG. 8.
Figure 12:
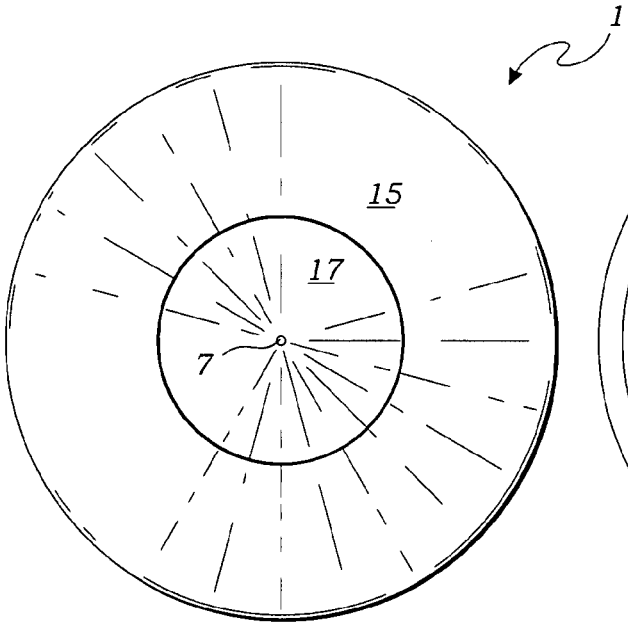
FIG. 12 is a top view of the glass breaking cap shown in FIG. 8.
Figure 13:
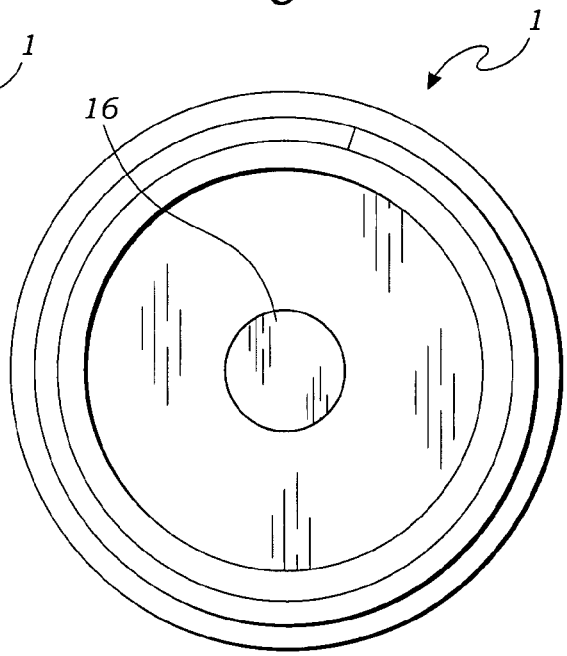
FIG. 13 is a bottom plan view of the glass breaking cap shown in FIG. 8.
Figure 14:
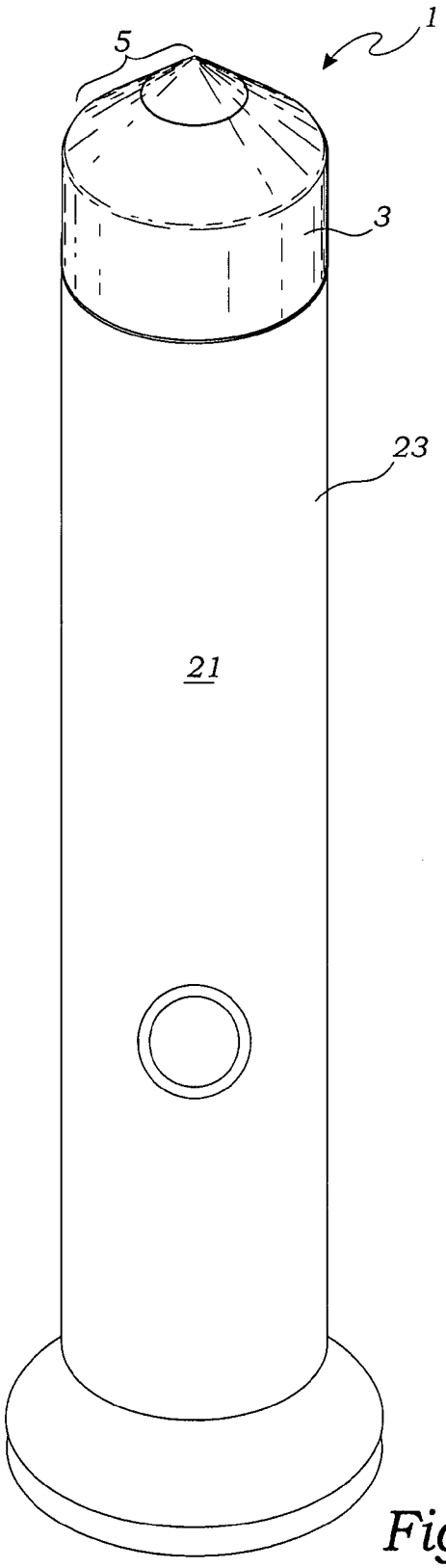
FIG. 14 is a perspective view of the glass breaking cap constructed in two pieces affixed to a flashlight.
Figure 15:
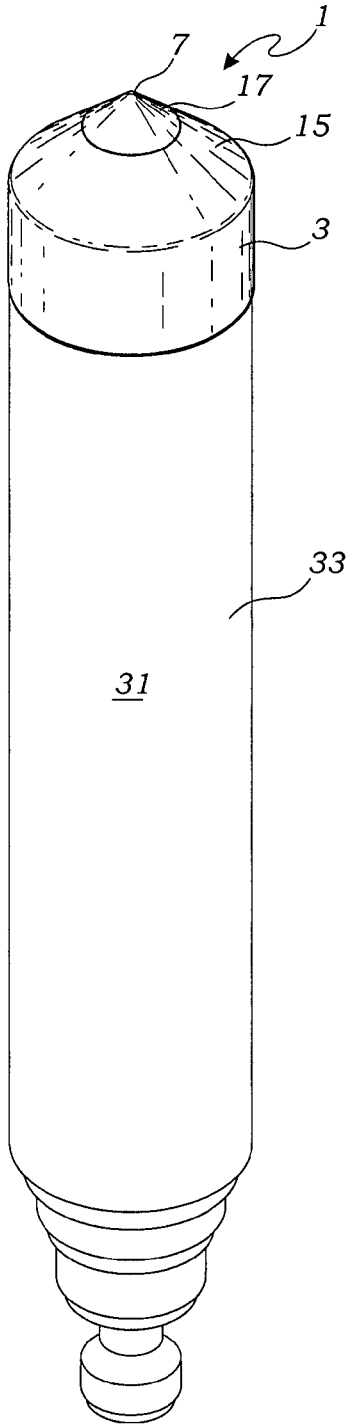
FIG. 15 is a perspective view of the glass breaking cap constructed in two pieces affixed to a retracted baton.
Figure 16:
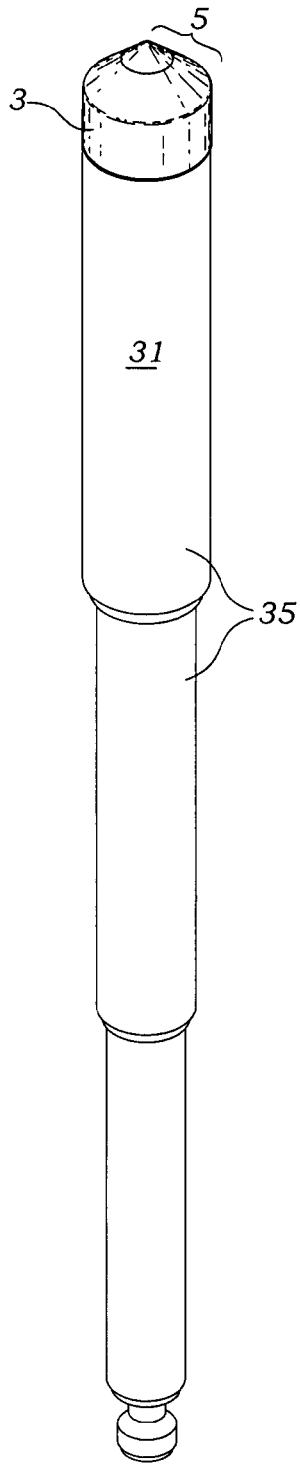
FIG. 16 is a perspective view of the glass breaking cap constructed in two pieces affixed to an extended baton.

As illustrated in FIGS. 10 and 11, the tip portion 17 includes the conical top portion's apex 7. As with the previously described embodiments, the apex has an included angle 9 between 86° and 136°. More preferable, the apex's included angle is between 106° and 126°, and the preferred included angle for the tip portion's apex 7 is 116°.

Figure 17:
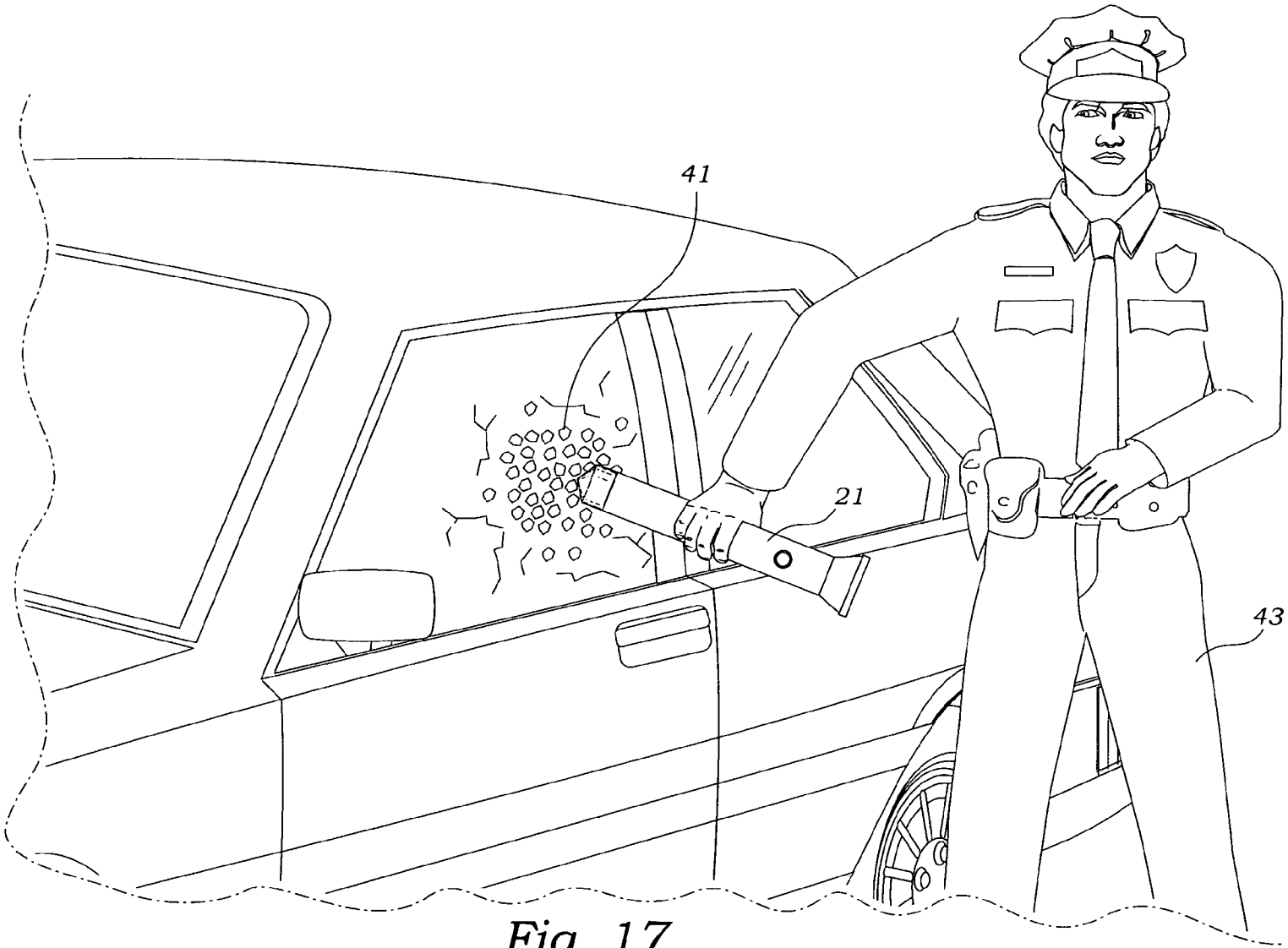
FIG. 17 is a perspective view of the glass breaking cap for flashlights and batons affixed to the end of a flashlight in use breaking the side window of a vehicle.
Figure 19:
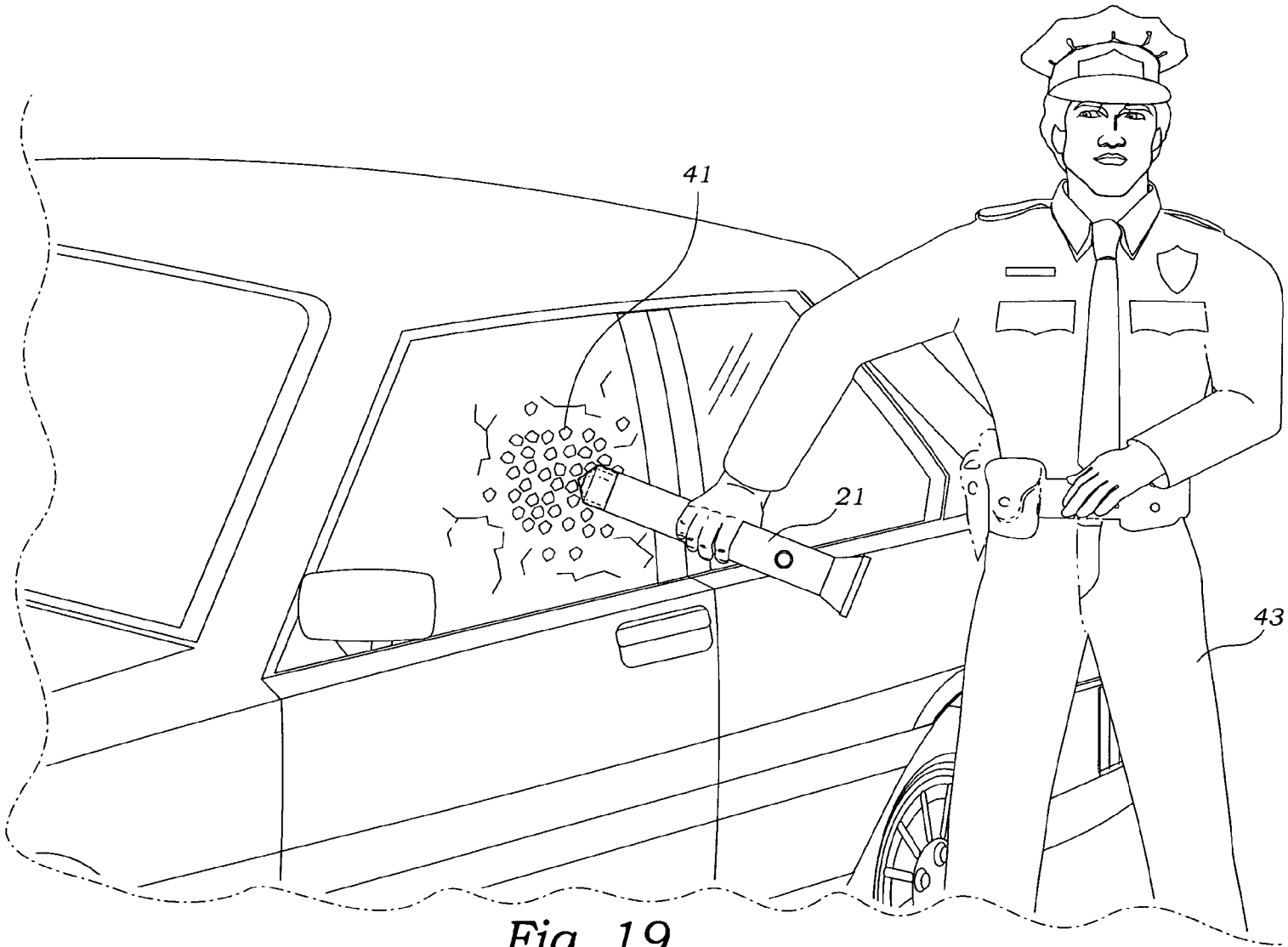
FIG. 19 is a perspective view of the glass breaking cap constructed in two pieces affixed to the end of a flashlight in use breaking the side window of a vehicle.

With reference to FIGS. 17 and 19, the glass breaking cap 1 affixed to the end of a flashlight 21 or baton can be wielded by all law enforcement personnel to easily break glass including the side windows of an automobile. Advantageously, the construction of the conical top portion enables persons to break glass using minimal force, typically requiring that a person hold the flashlight or baton with only one hand.

Figure 18:
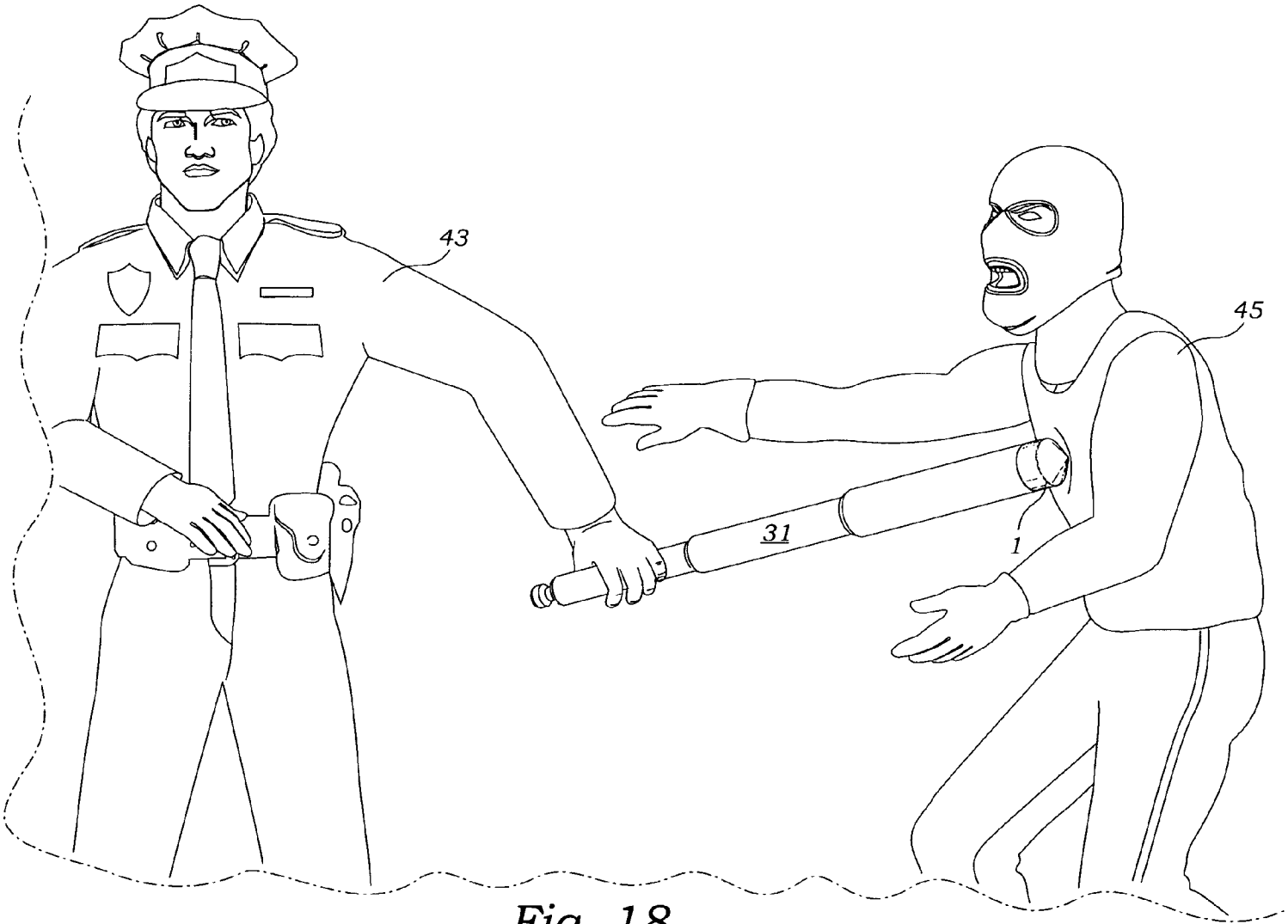
FIG. 18 is a perspective view of the glass breaking cap affixed to the end of an extended baton in use in applying non-deadly force to a criminal assailant.
Figure 20:
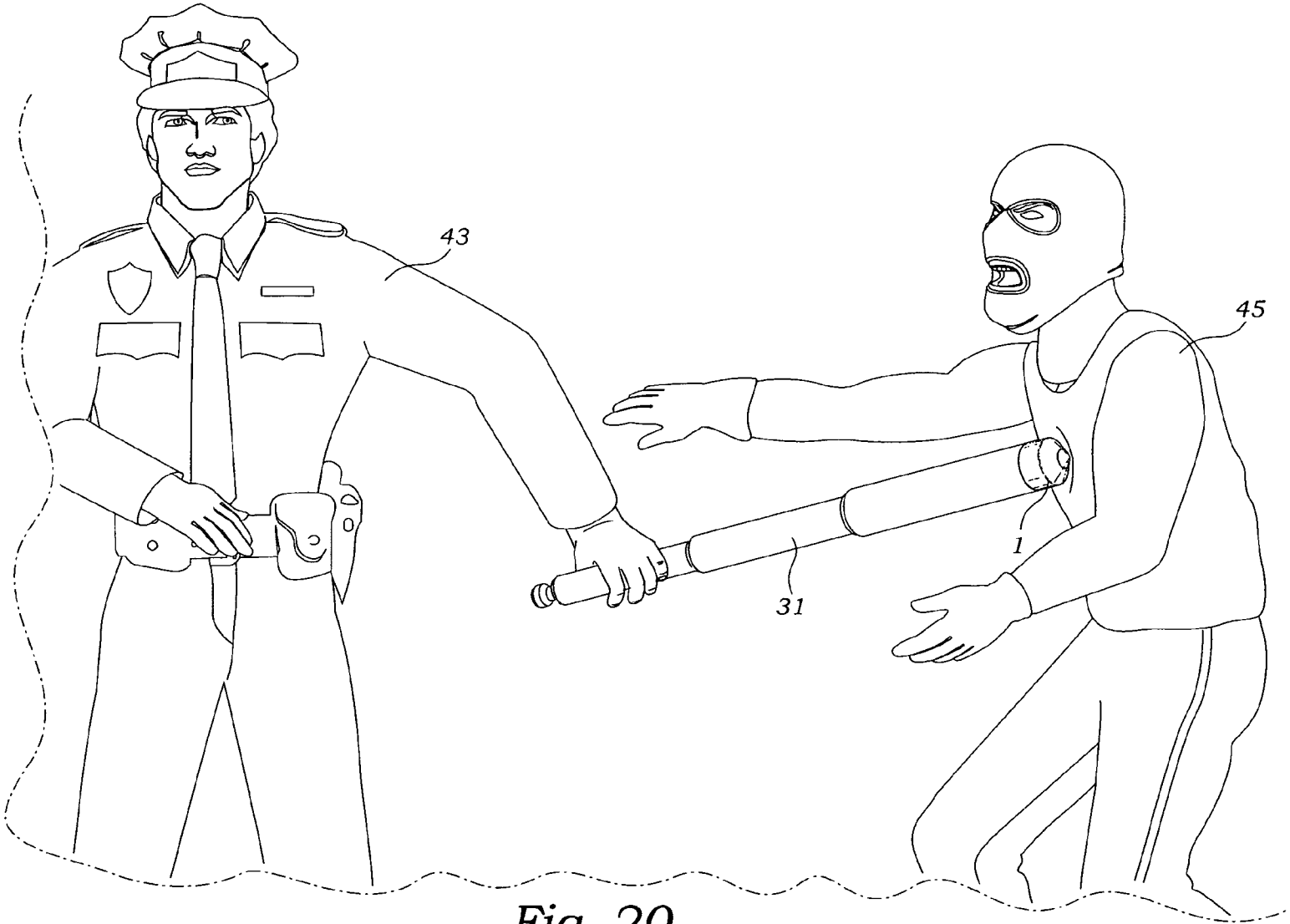
FIG. 20 is a perspective view of the glass breaking cap constructed in two pieces affixed to the end of an extended baton in use applying non-deadly force to a criminal assailant.

Also advantageously, as illustrated in FIGS. 18 and 20, the glass breaking cap 1 can be forcibly used against criminal assailants 45. The glass breaking cap 1 has a sufficiently blunt apex 7 so as to typically not cause deadly force if used by law enforcement personnel against criminals.

While several particular forms of the invention have been illustrated and described, it will be apparent that various modifications can be made without departing from the spirit and scope of the invention. Accordingly, it is not intended that the invention be limited except by the following claims. Having described my invention in such terms so as to enable persons skilled in the art to understand the invention, recreate the invention and practice it, and having identified the presently preferred embodiments thereof,

I claim:

1. A glass breaking cap for affixing to a flashlight or baton comprising;

a cap having a cylindrical sidewall that defines said cap's outer circumference and a substantially conical top portion having a base engaging and extending to the outer edge of said cylindrical sidewall and an apex having an included angle between 106° and 136°; and a threaded fastener for engaging the mating threads of a flashlight or baton.

2. The glass breaking cap of claim 1 wherein said threaded fastener includes male threads.

3. The glass breaking cap of claim 1 wherein said threaded fastener includes female threads.

4. The glass breaking cap of claim 1 wherein said included angle is between 106° and 126°.

5. The glass breaking cap of claim 1 wherein said included angle is between 111° and 121°.

6. The glass breaking cap of claim 1 wherein said annular element is made of aluminum and said tip element has a Rockwell hardness between 52 and 55.

7. The glass breaking cap of claim 1 wherein said conical top portion is constructed of two pieces including an annular element and a tip element, said tip element has a greater density and hardness than said annular element.

8. The glass breaking cap of claim 1 wherein said conical top portion is constructed of two pieces including an annular element and a tip element, and said annular element is made of aluminum and said tip element has a Rockwell hardness between 52 and 55.

9. A flashlight having a glass breaking cap comprising:

a flashlight body including threads for engaging a cap;

a cap having a cylindrical sidewall that defines said cap's outer circumference and a substantially conical top portion having a base engaging and extending to the outer edge of said cylindrical sidewall and an apex having an included angle between 106° and 136°, said conical top portion base extending to the outer edge of said cylindrical sidewall; and a threaded fastener for engaging the mating threads of said flashlight body.

10. The flashlight having a glass breaking cap of claim 9 wherein said included angle is between 106° and 126°.

11. The flashlight having a glass breaking cap of claim 9 wherein said included angle is between 111° and 121°.

12. The flashlight having a glass breaking cap of claim 9 wherein said annular element is made of aluminum and said tip element has a Rockwell hardness between 52 and 55.

13. The flashlight having a glass breaking cap of claim 9 wherein said conical top portion is constructed of two pieces including an annular element and a tip element, and said tip element has a greater density and hardness than said annular element.

14. The flashlight having a glass breaking cap of claim 9 wherein said conical top portion is constructed of two pieces including an annular element and a tip element, and said annular element is made of aluminum and said tip element has a Rockwell hardness between 52 and 55.

15. A baton having a glass breaking cap comprising:

a baton body including threads for engaging a cap;

a cap having a cylindrical sidewall that defines said cap's outer circumference and a substantially conical top portion having a base engaging and extending to the outer edge of said cylindrical sidewall said cylindrical sidewall and an apex having an included angle between 106° and 136°; and a threaded fastener for engaging the mating threads of said baton body.

16. The baton having a glass breaking cap of claim 15 wherein said included angle is between 106° and 126°.

17. The baton having a glass breaking cap of claim 15 wherein said included angle is between 111° and 121°.

18. The baton having a glass breaking cap of claim 15 wherein said annular element is made of aluminum and said tip element has a Rockwell hardness between 52 and 55.

19. The baton having a glass breaking cap of claim 15 wherein said conical top portion is constructed of two pieces including an annular element and a tip element, and said tip element has a greater density and hardness than said annular element.

20. The baton having a glass breaking cap of claim 15 wherein said conical top portion is constructed of two pieces including an annular element and a tip element, and said annular element is made of aluminum and said tip element has a Rockwell hardness between 52 and 55.

* * * * *